United States Patent [19]

Chen

[11] Patent Number: 4,975,712

[45] Date of Patent: Dec. 4, 1990

[54] TWO-DIMENSIONAL SCANNING ANTENNA

[75] Inventor: Chao C. Chen, Torrance, Calif.

[73] Assignee: TRW Inc., Redondo Beach, Calif.

[21] Appl. No.: 299,481

[22] Filed: Jan. 23, 1989

[51] Int. Cl.[5] ..... H01Q 19/060; H01Q 15/040

[52] U.S. Cl. ..... 343/754; 343/753; 343/909

[58] Field of Search ..... 343/753, 754, 755, 757, 343/777, 778, 780, 762, 909; 333/113, 135, 157

[56] References Cited

U.S. PATENT DOCUMENTS

| | | | |
|---|---|---|---|
| 3,276,023 | 9/1966 | Dorne et al. | 343/754 |
| 3,708,796 | 1/1973 | Gilbert | 343/754 |
| 4,169,268 | 9/1979 | Schell et al. | 343/909 |
| 4,212,014 | 7/1980 | Chekroun | 343/754 |
| 4,266,203 | 5/1981 | Sandreaau et al. | 333/21 A |
| 4,297,708 | 10/1981 | Vidal | 343/754 |
| 4,297,710 | 10/1981 | Dupressoir | 343/780 |
| 4,320,404 | 3/1982 | Chekroun | 343/780 |
| 4,358,771 | 11/1982 | Hsieh | 343/854 |
| 4,382,261 | 5/1983 | Freibergs et al. | 343/754 |
| 4,447,815 | 5/1984 | Chekroun et al. | 343/754 |
| 4,518,966 | 5/1985 | Sadones | 343/754 |
| 4,531,126 | 7/1985 | Sadones | 343/17.7 |
| 4,636,799 | 1/1987 | Kubick | 343/754 |

OTHER PUBLICATIONS

Phased Array Antena for Airborne Application, Tang, R., et al., Microwave Journal, vol. 14, No. 1, Jan. 1971.

A Distributed PIN-Diode Phaser For Millimeter Wavelengths, Weidner, G. G., et al., Microwave Journal, vol. 16, No. 11, Nov., 1973.

*Primary Examiner*—Rolf Hille

*Assistant Examiner*—Peter Toby Brown

*Attorney, Agent, or Firm*—Noel F. Heal; Ronald M. Taylor

[57] ABSTRACT

A two-dimensionally scannable antenna system for transmission or receiving a microwave beam over a wide angular region, using multiple parallel plate lenses for focusing and to provide, in conjunction with a like number of phase shifters, scanning of the beam in one transverse direction, such as in azimuth. The multiple parallel plate lenses provide output signals for processing by a single diode grid lens, which provides for deflection of the beam about the other transverse axis, to scan the beam in elevation. The diode grid lens includes parallel conductive plates with a thickness tapered from a minimum value near the input and output of the diode grid lens, to a maximum value over most of the length of the diode grid lens. This increased thickness of the plates reduces the required number of switchable diodes in the diode grid lens. The device of the invention has fewer components, lower power consumption and corresponding lower cost than similar configurations available prior to the present invention.

26 Claims, 4 Drawing Sheets

DIODES OFF

DIODES ON

TWO-DIMENSIONAL SCANNING ANTENNA

BACKGROUND OF THE INVENTION

This invention relates generally to phased-array antennas and, more particularly, to phased-array antenna systems that are electronically steerable in two dimensions. The advantages of inertialess scanning antenna systems for land-based and mobile radar systems are well known. It is also well known that arrays of antenna elements can be electronically steered by subjecting a transmitted or received signal to appropriate phase delays. Although the theory of such systems is well known, their complexity and high cost have severely limited their use.

One well known technique for selectively phase-shifting a microwave beam is to employ a diode grid lens of the type disclosed in a number of prior patents. For example, U.S. Pat. No. 3,708,796 to Gilbert discloses an electrically controlled dielectric panel lens for this purpose. In accordance with this technique, the microwave beam is passed through at least one dielectric panel in which is embedded a plane network of conductive leads running parallel with the direction of the electric field of the incident wave. Switches, usually in the form of diodes, are series connected in each such lead and are spaced from each other by distances less than two wavelengths, as measured in the dielectric material. It is noted in the Gilbert patent specification that the phase shift applied to the microwave beam passing through the dielectric panel varied according to the conductive states of the switches in the conductive leads. The phase shift is maximized when the microwave radiation is passed through portions of the panel in which the switches have been opened, and is minimized in portions in which the switches have been closed. This principle was also disclosed by A. Dorne et al. in an earlier U.S. patent (Pat. No. 3,276,023). Gilbert also recognized that two such lenses could be suitably oriented to deflect a beam about two orthogonal axes. The lenses are then separated by a polarization rotator, to rotate the direction of the electric field before the beam impinges on the second lens.

The design of diode grid arrays for use in antenna structures has since been further refined in other devices and patents. In particular, it is known to employ multiple parallel conductive plates as waveguides, dividing a microwave beam into multiple beam "slices," each of which will be subject to potentially different phase shifts. The conductive plates are oriented perpendicular to the direction of the conductive leads containing the switchable diodes. Typically, the diodes are arranged on grids or strips disposed between the plates. There are multiple diodes on each strip, and multiple strips are encountered by a wave propagating through the array. A typical array might provide multiple-bit phase shifting. For example, in a "three-bit" phase shifter each waveguide element of the array includes three groups of switchable diodes, each of which provides a phase shift related to that provided by its neighboring group by a factor of two. One group of diode strips might provide a phase shift of 45 degrees, an adjacent group, having more diodes, a phase shift of 90 degrees, and the next adjacent group, having still more diodes, a phase shift of 180 degrees. The three groups together can then provide a phase shift from zero to 315 degrees in increments of 45 degrees.

An important disadvantage of diode grid arrays for phase shifting microwave beams is that the number of diodes required for an array of practical size is very large. For an array of between one and two hundred phase shifters, the number of diodes will be several hundred thousand. The power dissipated by these diodes is also large and may render the structure unsuitable for some applications. In addition, there is a practical problem in wiring the diodes for independent switching operation. Although the diodes may be switched in groups, the number of wires needed to achieve a desired deflection of the beam is still in the thousands.

These numbers must be doubled if a second such array is used to provide beam deflection in an orthogonal direction, to provide scanning of the beam both in elevation and in azimuth. As a result, the use of two diode grid lens arrays for microwave beam scanning is an unacceptable approach for many radar and communications systems with a requirement for a wide-angle two-dimensional electronic scanning antenna. A system employing two diode grid lenses provides limited scanning capabilities, and is simply too complex, too heavy, too difficult to cool, too costly, and too inefficient. Accordingly, there is a real need for an alternative approach to providing a wide-angle two-dimensional scanning antenna. The present invention fulfills this need, as will be apparent from the following summary.

SUMMARY OF THE INVENTION

The present invention resides in a two-dimensional electronic scanning antenna system having a much simpler and less expensive structure than a conventional scanning antenna of the same size and scanning capability. In particular, the antenna system of the invention has only one-third or even fewer diodes than the conventional system, with a correspondingly reduced power consumption and correspondingly less complex wiring and overall cost.

Briefly, and in general terms, the system of the invention includes means for generating or detecting a plurality of microwave beams of relatively small cross section, an equal plurality of phase-shifting devices, for selectively controlling the relative phase of each of the plurality of microwave beams, and microwave lens means, for changing the cross section of each of the microwave beams. The microwave lens means has a first plurality of ports for coupling to the phase-shifting devices, and a second, equal plurality of ports of enlarged aperture in a first transverse direction with respect to the propagation direction. The microwave lens means are disposed in an array to permit beam scanning in a second transverse direction upon adjustment of the phase-shifting devices. The system of the invention also includes a diode grid lens positioned in proximity to the microwave lens means, for selectively introducing phase delays, to effect beam scanning in the first transverse direction.

In the illustrative embodiment of the invention, the diode grid lens includes a plurality of parallel conductive plates aligned in the second transverse direction, and parallel to the direction of propagation, and a plurality of diodes connected at various locations between the parallel conductive plates, the diodes being switchable to introduce desired phase shifts in microwave beam portions guided between adjacent parallel conductive plates. In the illustrative embodiment of the invention, the parallel conductive plates may be considered to have input edges nearer to the microwave lens means, and output edges opposite the input edges. The parallel conductive plates are tapered from a minimum thickness at their input and output edges to a maximum thickness over the greater part of their length between the input and output edges, to form planar waveguides between the plates. The planar waveguides have a much smaller depth, over the greater part of their length, than the periodic spacing of the conductive plates. The number of diodes connected between any two adjacent plates is minimized by the increased thickness of the plates, and the total number of diodes is reduced by a factor of at least two.

In accordance with another feature of the invention, at least some of the parallel conductive plates have internal cooling ducts to facilitate cooling of the diode grid lens.

In the preferred embodiment of the invention, the microwave lens means includes a plurality of parallel plate lenses, each of which has two reflectors and a doubly folded planar waveguide of expanding width, extending from one of the first plurality of ports to each reflector in turn, and then to one of the second plurality of ports. More specifically each of the parallel plate lenses includes a main reflector and a subreflector, and first, second and third planar waveguide sections. The first planar waveguide section diverges in width as it extends from one of the first plurality of ports, such that microwave radiation from the first port impinges on and substantially fills the subreflector, which presents a convex surface to radiation impinging on it. The second planar waveguide section overlies the first planar waveguide section, and diverges in width as it extends from the subreflector to the main reflector, which is larger than the subreflector and presents a concave surface to radiation impinging on it. The third planar waveguide section overlies the second planar waveguide section, and couples the main reflector to one of the second plurality of ports, which has an enlarged aperture in the direction of divergence of the first and second planar waveguide sections.

As will be recognized, a principal aspect of this invention concerns a diode grid lens for selectively scanning a microwave beam in a direction transverse to its propagation direction. The diode grid lens of the present invention comprises a plurality of generally parallel conductive plates disposed in an array with the plates parallel to the direction of propagation, the plates defining a plurality of planar waveguides through which a microwave beam is propagated. A plurality of diodes are connected between adjacent plates, and are switchable to interpose selected phase delays in each of the plurality of planar waveguides defined by the plates, thereby angularly scanning the beam in a plane perpendicular to the plates. In the diode grid lens of the invention, the plates have opposite input and output edges, and are tapered from a minimum thickness at the input and output edges to a maximum thickness along the greater part of the plate lengths, such that the waveguides are relatively thin in cross section over that part of their length in which the diodes are installed, and can operate efficiently with only single diodes installed between adjacent conductive plates at selected points in the waveguides. In this manner, the number of diodes, the power consumption, the complexity, and the cost of the diode grid lens are all greatly reduced.

Preferably, the diodes are arranged in groups having selected numbers of diodes, to provide for phase delays of various amounts in a binary succession, by selective switching of the diodes. At least some of the parallel conductive plates have internal cooling ducts to facilitate cooling of the diode grid lens.

It will be understood that the structure described may be employed as a transmitter or as a receiver of microwave radiation, although the detailed description that follows is written largely in terms of a microwave transmitter.

It will be appreciated from the foregoing that the present invention represents a significant advance in the field of electronically steerable antenna arrays. In particular, the invention provides a less complex, lighter, and less costly configuration of beam steering elements, without loss of efficiency or power transmission capability. Other aspects and advantages of the invention will become apparent from the following more detailed description, taken in conjunction with the accompanying drawings.

Figure 6A:
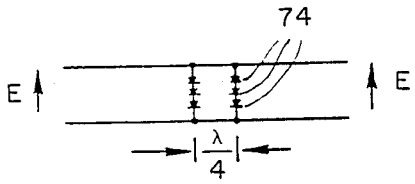
FIG. 6a (PRIOR ART)
Figure 6B:
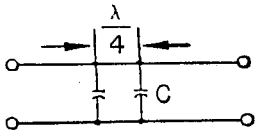
FIG. 6b (PRIOR ART)
Figure 7:
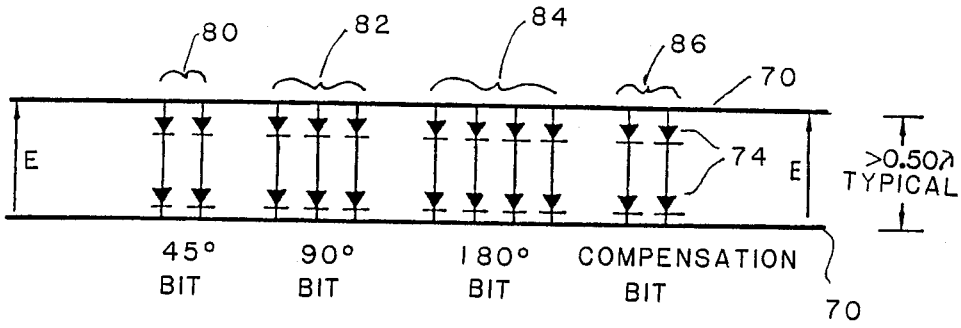
FIG. 7 (PRIOR ART)
Figure 8:
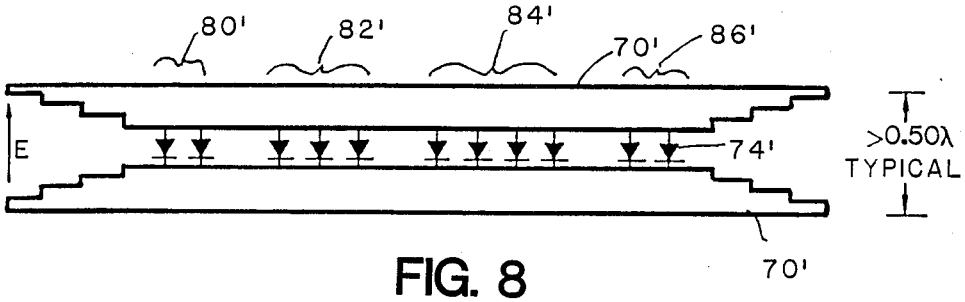
Figure 9:
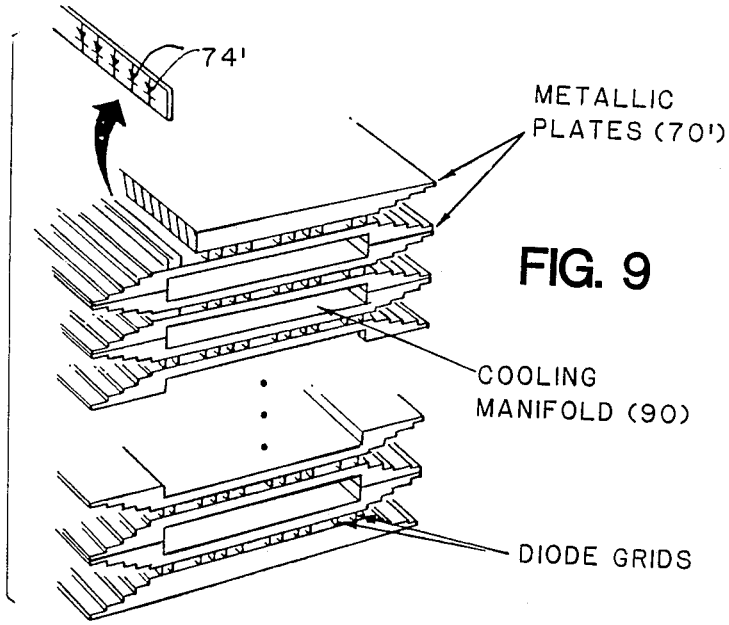
Figure 10:
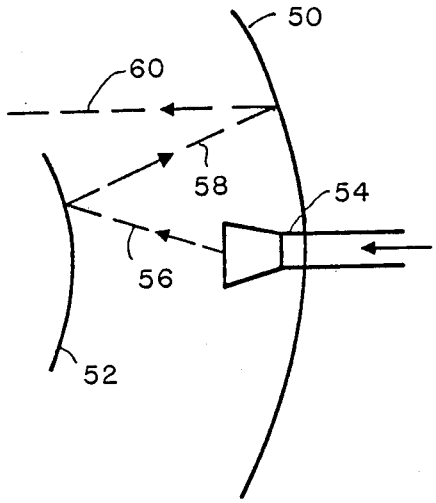
Figure 11:
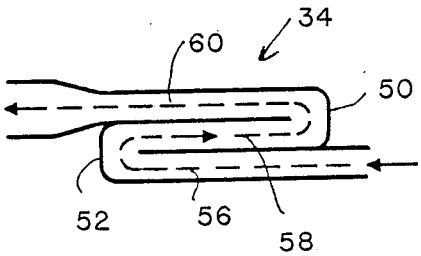

FIG. **6*a*** is a schematic diagram of an isolated one-bit phase shifter having two strings of diodes;

FIG. **6*b* is the equivalent circuit of the phase shifter of FIG. 6*a***, with the diodes in an "off" state;

FIG. **6*c* is the equivalent circuit of the phase shifter of FIG. 6*a***, with the diodes in an "on" state;

FIG. 7 is a simplified elevational view showing a typical arrangement of diodes between two plates of a diode grid lens;

FIG. 8 is a simplified elevational view similar to FIG. 7, but showing an important improvement of the invention;

FIG. 9 is a fragmentary isometric view of the diode grid lens of the invention;

FIG. 10 is a diagrammatic view showing the internal structure of one of a plurality of "pillbox" lenses used for beam deflection in one plane; and FIG. 11 is a cross-sectional view taken substantially along the line 10—10 of FIG. 9.

DESCRIPTION OF THE PREFERRED EMBODIMENT

As shown in the drawings for purposes of illustration, the present invention is concerned with phased-array antenna systems, and particularly with phased-array antenna systems capable of steering an antenna beam through a relatively wide angle, and in both azimuth and elevation directions. The use of two diode grid lenses in cascade is an inefficient and costly combination, with large numbers of diodes and a relatively high power consumption.

In accordance with the present invention, the complexity of the system, as particularly reflected in the number of diodes, is greatly reduced by two important and closely related innovations. One is to employ only one diode grid lens, for beam deflection in one plane, with deflection in the other plane being provided by an array of parallel plate lenses with individual phase shifters. The other innovation resides in the structure of the diode grid lens, which has approximately only one-half the number of diodes of a conventional diode grid lens of the same capability. Both these innovations will now be described in more detail.

It will be understood that scanning antenna systems may operated as receivers as well as transmitters of radiation. Scanning systems are most often described in terms of transmission of radiation, and they are usually easier to understand as transmitters. However, the beam scanning and phase shifting operations described function in exactly the same manner for receivers, except that the direction of propagation of radiation in the components is reversed. Also, instead of a radiation source for a transmitter, a radiation detector is employed in a receiver.

Figure 1:
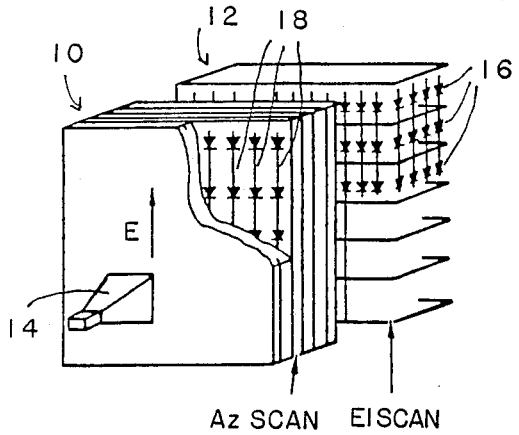
FIG. 1 (PRIOR ART)
FIG. 1 is a diagrammatic representation of a prior art two-dimensional scanning antenna system, using H-plane scanning.

By way of further background, FIG. 1 shows a two-dimensional beam scanning system of the prior art, employing two diode grid lenses, indicated by reference numerals 10 and 12. A microwave beam is provided by a feed horn 14, and passes first through diode grid lens 10, which comprises a three-dimensional array of diodes 16 connected in strings by conductive lines 18 that are all parallel with the E-field direction of the incident beam, as indicated by the arrow E, which is shown as being vertical. By appropriately switching the diodes 16 on and off, the beam can be scanned in a horizontal or azimuth sense by the first diode grid lens 10, and by the second diode grid lens 12 in an elevational sense.

Figure 2:
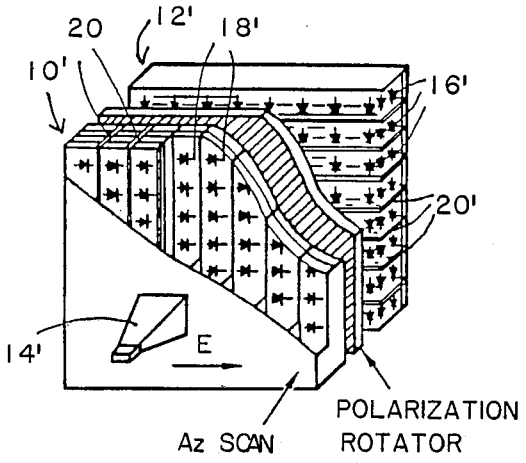
FIG. 2 (PRIOR ART)
FIG. 2 is a diagrammatic representation of a another prior art two-dimensional scanning antenna system using E-plane scanning.

The system shown in FIG. 2 also has a feed horn 14' and two diode grid lenses 10' and 12'. The first lens 10' has parallel conductive plates 20 and an array of diodes 16' connected by lines 18' that extend horizontally, that is to say perpendicular to the plates 20 and parallel to the electric field vector E of the incident wave. Appropriate switching of the diodes in the first diode grid lens 10 results in scanning of the beam in the E-plane direction, which is the azimuth direction as illustrated. The radiation emerging from the first diode grid lens 10 is rotated in polarization by 90 degrees, by means of a polarization rotator 22, and then passes through the second diode grid lens 12', which has a set of parallel conductive plates 20' and diodes 16' connected in vertically aligned connectors 18' between the plates. E-plane scanning in the second lens 12' results in scanning of the beam in the elevational direction.

Both structures (FIGS. 1 and 2) are subject to the disadvantage that they employ extremely large numbers of diodes, which dissipate a large aggregate power and require complex wiring and control circuitry. They are also costly to build, and the tandem arrangement of the two diode grid lenses is inefficient in its operation.

Figure 3:
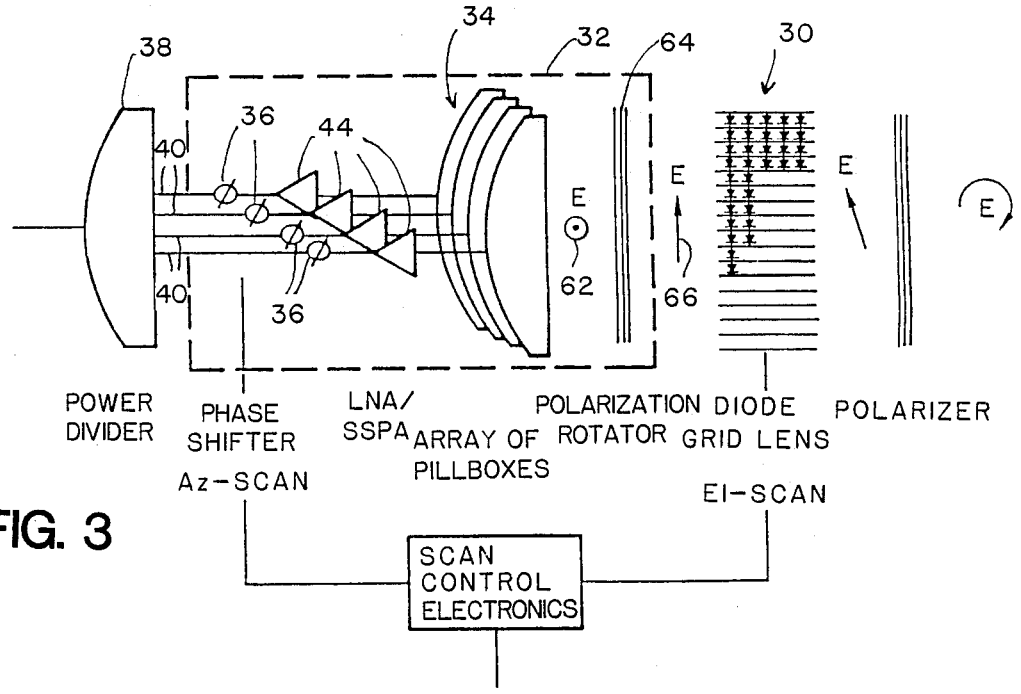
FIG. 3 is a diagrammatic representation of a two-dimensional scanning antenna system in accordance with the present invention.
Figure 4:
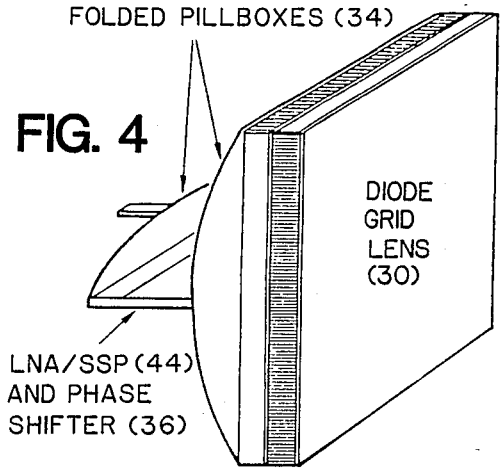
FIG. 4 is a simplified isometric view showing the scanning antenna system of FIG. 3.

FIGS. 3 and 4 show the alternative construction of the present invention, in which a single diode grid lens 30 is used for scanning in the elevation direction, but scanning in azimuth is achieved by means of the arrangement shown within the broken lines 32. This includes an array of parallel plate lenses or "pillboxes" 34, fed through individual phase shifters 36. A power divider 38 provides a plurality (N) of outputs on lines 40, each of which is connected through its own conventional phase delay device 36 and amplifier 44, before being input to its corresponding pillbox 34. The power divider 38 may take the form of an additional parallel plate lens, similar to the pillboxes 34, except that multiple outputs are derived from the power divider, rather than a single output with an expanded aperture.

Each pillbox 34 or parallel plate lens is constructed as shown in FIGS. 10 and 11. Each has a concave main reflector 50 and a convex subreflector 52. Radio-frequency (rf) energy is input to the pillbox 34 through a feed horn 54 centrally located with respect to the main reflector 50 as viewed in elevation (FIG. 10), but displaced to one side of the main reflector, as shown in FIG. 11. Input energy passes first to one side of the main reflector 50, as indicated at 56 in FIG . 11, and impinges on the subreflector 52. The structure includes an input waveguide path 56, an intermediate return waveguide path 58 and an output waveguide path 60. After reflection from the subreflector 52, the rf energy is incident on the main reflector 50, and then follows the output waveguide path to one side of the subreflector 52. This three-dimensional design of the pillbox lens 34 provides an output beam of increased aperture in one direction and narrow beam width in a perpendicular direction. Moreover, the pillbox lens achieves this aperture enlargement and focusing effect without any loss of efficiency or uniformity that might be caused by shadowing of the beam by the subreflector 52 or the feed horn 54. Shadowing is avoided because of the doubly folded transmission path, which also provides a very compact structural arrangement.

Selective activation of the individual phase shifters 36 provides scanning of the output beams from the pillboxes 34, in an azimuth sense. At the point of output from the pillboxes 34, the E-field direction is perpendicular to the plane of the pillboxes 34, as shown at 62. A conventional polarization rotator 64 rotates the plane of polarization of the radiation by 90 degrees, such that the E-field direction is than parallel to the plane of the pillboxes 34, as shown at 66.

Processing after azimuth control in the pillbox configuration 32 is achieved by means of the single diode grid lens 30, which is used for control of the elevation beam angle. It will be apparent that the invention as described thus far achieves an approximately fifty-percent or greater reduction in the number of diodes, since only one diode grid lens is employed, instead of the two used in prior systems. In addition, the pillbox configuration 32 provides focusing of the microwave beam. An arrangement of two diode grid lenses provides no gain and has to use additional components for beam focusing.

The use of the pillbox or equivalent means for deflection in one dimension also provides an improvement of between 2dB and 5dB in effective isotropic radiated power (EIRP) compared with the radiated power of an equivalent system using two diode grid lenses. The new configuration of the invention also facilitates the use of microwave integrated circuit (MIC) techniques for fabrication of the various components.

Even though the use of a single diode grid lens in conjunction with a pillbox array provides significant advantages, it is preferable that the single diode grid lens 30 be of an improved design that reduces the number of diodes even further.

Figure 5:
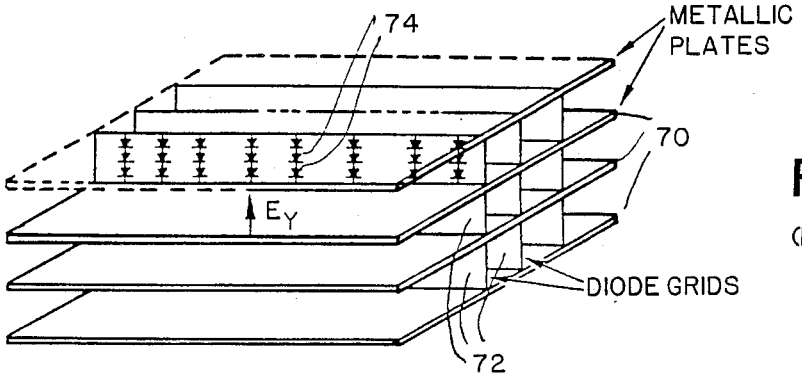
FIG. 5 (PRIOR ART)
FIG. 5 is a diagrammatic and simplified view showing a portion of the structure of a diode grid lens.
Figure 6C:
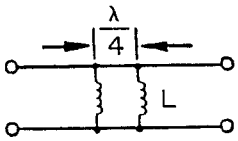
FIG. 6c (PRIOR ART)

FIG. 5 shows by way of further background a portion of a diode grid lens, including a plurality of parallel plates 70, between which are disposed a plurality of diode grids 72. Each diode grid 72 is of dielectric material and has a plurality of diodes 74 arranged in conductive paths that run perpendicular to the plates 70. The electrical circuit formed by a one-bit phase shifter in a diode grid lens is shown in FIG. 6*a*. This configuration has two strings of diodes 74 spaced apart by a distance of a quarter-wavelength, as measured in the dielectric material of the diode grids 72. Each string of diodes in the exemplary one-bit phase shifter has two series-connected diodes. The equivalent circuit of this configuration when the diodes are off is shown in FIG. *bb*. The diodes then may be represented by parallel capacitors between the conductive plates. When the diodes are on, they may be represented as parallel inductors between the plates, as shown in FIG. 6*c*.

FIG. 7 shows a typical arrangement of diodes 74 connected between plates 70 to form a three-bit phase shifter. To provide phase shifts of 45 degrees two parallel strings of diodes are used, as indicated at 80, but it will be understood that additional pairs of strings are required across the width of the plates 70. Each string of diodes is shown as including two series-connected diodes. The number actually used may be two, three, or more, depending on the device design. Also included in the three-bit phase shifter are three strings of diodes comprising a 90-degree shifter, indicated at 82, and four strings of diodes comprising a 180-degree shifter, indicated at 84. Two additional strings of diodes, indicated at 86, may be used for phase compensation.

FIG. 8 shows a comparable arrangement in the diode grid lens of the present invention. Instead of the flat plates 70, the invention employs plates 70' that are tapered in thickness at opposite edges corresponding to input and output regions for the radiation transmitted through the lens. These tapered regions may be stepped, as illustrated in the figure, or smoothly tapered. In any event the tapered regions at input and output of the lens form a transition between free space wave propagation of a microwave beam and guided wave propagation in a planar waveguide. The spaces between the plates 70' are for the most part much smaller than the periodic spacing between the plates; so much smaller, in fact, that only a single diode 74' is needed for each diode string in a multi-bit phase shifter. The three-bit phase shifter of FIG. 8 includes a 45-degree bit 80' having two parallel diodes, a 90-degree bit 82' having three parallel diodes, a 180-degree bit 84' having four parallel diodes, and a compensation bit 86' having two parallel diodes.

It will be apparent from FIG. 8 that the improved diode grid lens of the present invention employs only half the number of diodes used in a conventional three-bit phase shifter of FIG. 7 having two diodes per string. If there are three diodes per string in the conventional phase shifter, the structure of the invention reduces the number of diodes by a factor of three. Power consumption is reduced by the same factor.

Another advantage of the new structure is shown in FIG. 9. Because the waveguides formed between the metal plates 70' are thinned over most of their length, the plates themselves can be thickened. This permits the convenient inclusion of cooling ducts 90 in the plates 70', to provide for more efficient heat dissipation from the diodes.

The system of the invention can be designed to operate at any desired nominal frequency, such as 20 GHz (gigahertz) or 60 GHz. Depending on the antenna application, the number of elements per antenna may be anywhere from a few hundred to several thousand.

It will be appreciated from the foregoing that the present invention represents a significant advance in the field of scanning antennas. In particular, the invention provides for two-dimensional beam scanning over wide angles, but with reduced complexity, weight and cost compared with similar systems of the prior art. The number of switching diodes employed is reduced by a factor of four or more compared with prior systems. Moreover, the system of the invention operates more efficiently and provides higher radiated power output than prior equivalent systems, in spite of its simplicity and lower cost. It will also be appreciated that, although an embodiment of the invention has been described in detail for purposes of illustration, various modifications may be made without departing from the spirit and scope of the invention. Accordingly, the invention is not to be limited except as by the appended claims.

I claim:

1. A two-dimensionally scanning antenna system, for angularly scanning in first and second transverse directions with respect to a principal beam propagation direction, the system comprising:

means for generating or detecting a plurality of microwave beams of relatively small cross section, in the principal propagation direction;

an equal plurality of phase-shifting devices, for selectively controlling the relative phase of each of the plurality of microwave beams;

microwave lens means, for changing the cross section of each of the plurality of microwave beams, the microwave lens means having a first plurality of ports for coupling to the phase-shifting devices, and a second, equal plurality of ports coupled to corresponding ones of the first plurality of ports, the second plurality of ports each having an enlarged aperture in the first transverse direction but not in the second transverse direction, the microwave lens means being disposed in an array to permit beam scanning in the second transverse direction upon adjustment of the phase-shifting devices; and a diode grid lens positioned in proximity to the microwave lens means, for selectively introducing phase delays, to effect beam scanning in the first transverse direction.

2. A two-dimensionally scanning antenna system as defined in claim 1, wherein the diode grid lens includes:

a plurality of parallel conductive plates aligned in the second transverse direction, and parallel to the principal propagation direction; and a plurality of diodes connected at various locations between the parallel conductive plates, the diodes being switchable to introduce phase shifts in microwave beam portions guided between adjacent parallel conductive plates.

3. A two-dimensionally scanning antenna system as defined in claim 2, wherein:

the parallel conductive plates are all of approximately equal width and equal length, have a uniform periodic spacing, and have opposite input and output edges;

the parallel conductive plates are tapered from a minimum thickness at their input and output edges, to a maximum thickness over a greater part of their length between the input and output edges, to form planar waveguides between adjacent parallel conductive plates, the planar waveguides having uniform width but having a depth that varies rom a maximum at the input and output edges to a minimum over a greater part of their length, the minimum waveguide depth being much smaller than the periodic spacing of the conductive plates; and the minimum waveguide depth between adjacent parallel conductive plates is small enough that the diodes between the parallel conductive plates can be connected in strings of only one diode each, and the total number of required diodes is therefore less than would be needed if the parallel conductive plates were not tapered, by a factor of at least two.

4. A two-dimensionally scanning antenna system as defined in claim 3, wherein:

at least some of the parallel conductive plates have internal cooling ducts to facilitate cooling of the diode grid lens.

5. A two-dimensionally scanning antenna system as defined in claim 1, wherein the microwave lens means includes a plurality of parallel plate lenses, each of which includes:

a convex reflector and a concave reflector;

a doubly folded planar waveguide of expanding width having a first section extending from one of the first plurality of ports to the convex reflector, a second section folded over the first and extending from the convex reflector to the concave reflector, and a third section folded over the second and extending from the concave reflector to one of second plurality of ports.

6. A two-dimensionally scanning antenna system, for angularly scanning in first and second transverse directions with respect to a principal beam propagation direction, the system comprising:

means for generating or detecting a plurality of microwave signals in the principal propagation direction;

an equal plurality of phase-shifting devices, for selectively controlling a relative phase of each of the plurality of microwave signals;

an equal plurality of parallel plate lenses coupled to the phase-shifting devices, each lens having a first input/output port of relatively small aperture, coupled to one of the phase-shifting devices, and a second input/output port providing a aperture enlargement in the first transverse direction, the parallel plate lenses being arrayed to produce or receive at their second input/output ports a composite microwave beam of which the relative phase can be varied for each parallel plate lens, to produce a scanning effect in the second transverse direction; and a diode grid lens positioned in proximity to the array of parallel plate lenses, for selectively introducing phase delays in the composite microwave beam, to effect scanning of the beam in the first transverse direction.

7. A two-dimensionally scanning antenna system as defined in claim 6, wherein the diode grid lens includes:

a plurality of parallel conductive plates aligned in a direction perpendicular to the parallel plate lenses and parallel to the principal propagation direction; and a plurality of diodes connected at various locations between the parallel conductive plates, the diodes being switchable to introduce a phase shift in each portion of the composite microwave beam guided between two adjacent ones of the parallel conductive plates.

8. A two-dimensionally scanning antenna system as defined in claim 7, wherein:

the parallel conductive plates are all of approximately equal width and equal length, have a uniform periodic spacing, and have input edges nearer to the array of parallel plate lenses, and output edges opposite the input edges;

the parallel conductive plates are tapered from a minimum thickness at their input and output edges, to a maximum thickness over a greater part of their length between the input and output edges, to form planar waveguides between adjacent parallel conductive plates, the planar waveguides having uniform width but having a depth that varies from a maximum at the input and output edges to a minimum over a greater part of their length, the minimum waveguide depth being much smaller than the periodic spacing of the parallel conductive plates; and the minimum waveguide depth between adjacent parallel conductive plates is small enough that the diodes between the parallel conductive plates can be connected in strings of only one diode each, and the total number of required diodes is therefore less than would be needed if the parallel conductive plates were not tapered, by a factor of at least two.

9. A two-dimensionally scanning antenna system as defined in claim 8, wherein:

at least some of the parallel conductive plates have internal cooling ducts to facilitate cooling of the diode grid lens.

10. A two-dimensionally scanning antenna system as defined in claim 6, wherein each of the parallel plate lenses includes:

a convex reflector and a concave reflector;

a doubly folded planar waveguide of expanding width having a firs section extending from the first input/output port to the convex reflector, a second section folded over the first and extending from the convex reflector to the concave reflector, and a third section folded over the second and extending from the concave reflector to the second input/output port.

11. A two-dimensionally scanning antenna system as defined in claim 6, wherein each of the parallel plate lenses includes:

a main reflector and a subreflector;

a first planar waveguide section diverging in width from the first input/output port, such that microwave radiation from the first input/output port impinges on substantially the entirety of the subreflector, which presents a convex surface to radiation impinging on it;

a second planar waveguide section overlying the first planar waveguide section, diverging in width from the subreflector to the main reflector, which is larger than the subreflector and presents a concave surface to radiation impinging on it; and a third planar waveguide section overlying the second planar waveguide section, and coupling the main reflector to the second input/output port, which has an enlarged aperture in a direction parallel to the first, second and third planar waveguide sections.

12. A diode grid lens for selectively scanning a microwave beam in a direction transverse to its principal propagation direction, the diode grid lens comprising:

a plurality of generally parallel conductive plates disposed in an array with the parallel conductive plates parallel to the principal propagation direction, the parallel conductive plates defining a plurality of planar waveguides through which the microwave beam is propagated; and a plurality of diodes connected between adjacent plates, and switchable to cause selected phase delays in each of the plurality of planar waveguides defined by the plates, thereby angularly scanning the beam in a plane perpendicular to the parallel conductive plates;

wherein the parallel conductive plates have opposite input and output edges, and are tapered from a minimum thickness at the input and output edges to a maximum thickness along the greater part of the plate lengths, such that the planar waveguides are relatively thin in cross section over that part of their length in which the diodes are installed, and can operate with only single diodes installed between adjacent parallel conductive plates at selected points in the planar waveguides, whereby the number of diodes, the power consumption, the complexity, and the cost of the diode grid lens are greatly reduced compared with a similar structure with parallel conductive plates that were not tapered in thickness.

13. A diode grid lens as defined in claim 12, wherein:

the diodes are arranged in groups having selected numbers of diodes, to provide for phase delays of various amounts in a binary succession, by selective switching of the diodes.

14. A diode grid lens as defined in claim 12, wherein:

at least some of the parallel conductive plates have internal cooling ducts to facilitate cooling of the diode grid lens.

15. A two-dimensionally scaning transmission antenna system, for angularly scanning in first and second transverse directions with respect to a principal beam propagation direction, the system comprising:

means for generating a plurality of microwave signals in the principal propagation direction;

an equal plurality of phase-shifting devices coupled to the means for generating the microwave signals, for selectively controlling a relative phase of each of the plurality of microwave signals;

an equal plurality of parallel plate lenses coupled to the phase-shifting devices, each parallel plate lens having an input port of relatively small aperture, coupled to a corresponding one of the phase-shifting devices, and an output port providing a aperture enlargement in the first transverse direction, the parallel plate lenses being arrayed to produce at their output ports a composite microwave beam of which the relative phase can be varied for each parallel plate lens, to produce a scanning effect in the second transverse direction; and a diode grid lens positioned to receive the composite microwave beam from the array of parallel plate lenses, for selectively introducing phase delays in the composite microwave beam, to effect scanning of the microwave composite beam in the first transverse direction.

16. A two-dimensionally scanning transmission antenna system as defined in claim 15, wherein the diode grid lens includes:

a plurality of parallel conductive plates aligned in a direction perpendicular to the parallel plate lenses and parallel to the principal propagation direction;

a plurality of diodes connected at various locations between the parallel conductive planes, the diodes being switchable to introduce a phase shift in each portion of the composite microwave beam guided between two adjacent ones of the parallel conductive plates.

17. A two-dimensionally scanning transmission antenna system as defined in claim 16, wherein:

the parallel conductive plates are all of approximately equal width and equal length, have a uniform periodic spacing, and have input edges nearer to the array of parallel plate lenses, and output edges opposite the input edges;

the parallel conductive pales are tapered from a minimum thickness at their input and output edges, to a maximum thickness over a greater part of their length between the input and output edges, to form planar waveguides between adjacent parallel conductive plates, the planar waveguides having uniform width but having a depth that varies rom a maximum at the input and output edges to a minimum over the greater part of their length, the minimum waveguide depth being much smaller than the periodic spacing of the parallel conductive plates; and the minimum waveguide depth between adjacent parallel conductive plates is small enough that the diodes between the parallel conductive plates can be connected in strings of only one diode each, and the total number of required diodes is therefore minimized.

18. A two-dimensionally scanning transmission antenna system as defined in claim 17, wherein:

at least some of the parallel conductive plates have internal cooling ducts to facilitate cooling of the diode grid lens.

19. A two-dimensionally scanning transmission antenna system as defined in claim 15, wherein each of the parallel plate lenses includes:

a convex reflector and a concave reflector;

a doubly folded planar waveguide of increasing width having a first section extending from the input port to the convex reflector, a second section folded over the first and extending from the convex reflector to the concave reflector, and a third section folded over the second and extending from the concave reflector to the output port.

20. A two-dimensionally scanning transmission antenna system as defined in claim 15, wherein each of the parallel plate lenses includes:

a main reflector and a subreflector;

a first planar waveguide section diverging in width from the input port, such that microwave radiation from the input port impinges on substantially the entirety of the subreflector, which presents a convex surface to radiation impinging on it;

a second planar waveguide section overlying the first planar waveguide section, diverging in width from the subreflector to the main reflector, which is larger than the subreflector and presents a concave surface to radiation impinging on it; and a third planar waveguide section overlying the second planar waveguide section, and coupling the main reflector to the output port, which has an enlarged aperture in a direction parallel to the first, second and third planar waveguide sections.

21. A two-dimensionally scanning receiving antenna system, for angularly scanning in first and second transverse directions with respect to a principal beam propagation direction, corresponding to scanning in elevation and azimuth, the system comprising:

a diode rid lens positioned to receive an input microwave beam from a selected direction, including means for selectively introducing phase delays in portions of the microwave beam, to permit reception of the input microwave beam from a selected elevational angle;

a plurality of parallel plate lenses coupled to receive intermediate microwave radiation from the diode grid lens, each parallel plate lens having an input port of relatively small aperture int he second transverse direction and a relatively large aperture in the first transverse direction, and an output port of relatively small aperture in both transverse directions, the parallel plate lenses being arrayed to receive at their input ports component portions of the intermediate microwave radiation from the diode grid lens, and to produce at tits output ports a plurality of output microwave signals derived from those component portions of the intermediate microwave radiation;

a plurality of phase-shifting devices, one for each parallel plate lens, coupled to the output ports of the parallel plate lenses, to provide for the reception of input microwave beams from a selected azimuth direction; and means coupled to the phase-shifting devices, for combining and detecting the plurality of output microwave signals output therefrom.

22. A two-dimensionally scanning receiving antenna system as defined in claim 21, wherein the diode grid lens includes:

a plurality of parallel conductive plates aligned in a direction perpendicular to the parallel plate lenses and parallel to the principal propagation direction of the received microwave signal in the diode grid lens; and a plurality of diodes connected at various locations between the parallel conductive plates, the diodes being switchable to introduce a desired phase shift in each portion of a composite microwave beam guided between two adjacent ones of the parallel conductive plates.

23. A two-dimensionally scanning receiving antenna system as defined in claim 22, wherein:

the parallel conductive plates are all of approximately equal width and equal length, have a uniform periodic spacing, and have input edges nearer to the array of parallel plate lenses, and output edges opposite the input edges;

the parallel conductive plates are tapered from a minimum thickness at their input and output edges, to a maximum thickness over the greater part of their length between the input and output edges, to form planar waveguides between the parallel conductive planes, the planar waveguides having a much smaller depth, over the greater part of their length, than the periodic spacing of the parallel conductive plates; and the parallel conductive plates are tapered from a minimum thickness at their input and output edges, to a maximum thickness over the greater part of their length between the input and output edges, to form planar waveguides between adjacent parallel conductive plates, the planar waveguides having uniform width but having a depth that varies from a maximum at the input and output edges to a minimum over a greater part of their length, the minimum waveguide depth being much smaller than the periodic spacing of the parallel conductive plates; and the number of diodes connected between any two adjacent parallel conductive plates is greatly reduced by an increased thickness of the parallel conductive plates, and the total number o diodes is reduced by a factor of at least two in comparison with a similar antenna system in which the parallel conductive plates were not tapered in thickness.

24. A two-dimensionally scanning receiving antenna system as defined in claim 23, wherein:

at least some of the parallel conductive plates have internal cooling ducts to facilitate cooling of the diode grid lens.

25. A two-dimensionally scanning receiving antenna system as defined in claim 21, wherein each of the parallel plate lenses includes:

a convex reflector and a concave reflector;

a doubly folded planar waveguide of decreasing width having a first section extending from the input port to the concave reflector, a second section folded over the first and extending from the concave reflector to the convex reflector, and a third section folded over the second and extending from the convex reflector to the output port.

26. A two-dimensionally scanning receiving antenna system as defined in claim 21, wherein each of the parallel plate lenses includes:

a main reflector and a subreflector;

a first planar waveguide section extending from the input port to the main reflector, such that microwave radiation from the input port impinges on substantially the entirety of the main reflector, which presents a concave surface to radiation impinging on it;

a second planar waveguide section overlying the first planar waveguide section, and converging in width from the main reflector to the subreflector, which is smaller than the main reflector and presents a convex surface to radiation impinging on it; and a third planar waveguide section overlying the second planar waveguide section, and coupling the subreflector to the output port, which has a reduced aperture in a direction parallel to the first, second and third planar waveguide sections.

* * * * *